US009689237B2

(12) United States Patent
Johnson et al.

(10) Patent No.: US 9,689,237 B2
(45) Date of Patent: Jun. 27, 2017

(54) DUAL BARRIER PERFORATING SYSTEM

(71) Applicant: Halliburton Energy Services, Inc., Houston, TX (US)

(72) Inventors: Michael Richard Johnson, Lafayette, LA (US); Blake Lyndon Arabie, Lafayette, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 466 days.

(21) Appl. No.: 14/340,798

(22) Filed: Jul. 25, 2014

(65) Prior Publication Data

US 2016/0024874 A1 Jan. 28, 2016

(51) Int. Cl.

| | |
|---|---|
| ***E21B 23/06*** | (2006.01) |
| ***E21B 33/124*** | (2006.01) |
| ***E21B 33/138*** | (2006.01) |
| ***E21B 34/12*** | (2006.01) |
| ***E21B 43/116*** | (2006.01) |
| ***E21B 33/128*** | (2006.01) |
| ***E21B 33/134*** | (2006.01) |

(52) U.S. Cl.
CPC ..... *E21B 43/116* (2013.01); *E21B 33/128* (2013.01); *E21B 33/134* (2013.01)

(58) Field of Classification Search
CPC .... E21B 33/128; E21B 33/134; E21B 43/116; E21B 33/10; E21B 33/13
See application file for complete search history.

(56) References Cited

U.S. PATENT DOCUMENTS 3,010,514 A * 11/1961 Fox ..... E21B 33/134 166/284
3,032,108 A * 5/1962 Bielstein ..... E21B 33/124 166/114
3,118,501 A * 1/1964 Kenley ..... E21B 43/116 166/177.5
3,189,096 A 6/1965 Phenix
4,523,643 A * 6/1985 McGlothen ..... E21B 43/116 166/297
4,566,538 A * 1/1986 Peterson ..... E21B 33/1295 166/278
4,834,184 A 5/1989 Streich et al.
5,174,379 A * 12/1992 Whiteley ..... E21B 43/116 166/126

(Continued)

OTHER PUBLICATIONS

Halliburton catalog, pp. 2-1 through 2-16, "floating equipment" (undated but admitted to be prior art).

(Continued)

*Primary Examiner* — Daniel P Stephenson
(74) *Attorney, Agent, or Firm* — McAfee & Taft A Professional Corporation

(57) ABSTRACT

A system and method for use in used in oil and gas wellbores is provided. More specifically, the disclosure relates to barriers or seals used in downhole operations involving activities such as perforating operations and well abandonment operations. The system and method relate to sealing a borehole such as when a well is being abandoned at the end of its productive life. The embodiments are particularly applicable to boreholes containing casing with an inner wall and an outer wall wherein an annulus is formed between the outer wall of the casing and the borehole wall.

16 Claims, 9 Drawing Sheets

(56) References Cited

U.S. PATENT DOCUMENTS

| | | | | |
|---|---|---|---|---|
| 5,330,000 | A | 7/1994 | Givens et al. | |
| 5,472,052 | A * | 12/1995 | Head | E21B 33/13 166/298 |
| 5,540,279 | A * | 7/1996 | Branch | E21B 33/1204 166/118 |
| 6,279,654 | B1 * | 8/2001 | Mosing | E21B 21/01 166/177.4 |
| 6,595,289 | B2 * | 7/2003 | Tumlin | E21B 33/134 166/177.4 |
| 7,878,242 | B2 * | 2/2011 | Gray | E21B 23/00 166/250.13 |
| 9,010,425 | B2 * | 4/2015 | Larsen | E21B 33/13 166/285 |
| 9,297,234 | B2 * | 3/2016 | Themig | E21B 34/08 |
| 2003/0230406 | A1 * | 12/2003 | Lund | E21B 33/124 166/278 |
| 2011/0203795 | A1 * | 8/2011 | Murphy | C09K 8/42 166/292 |
| 2013/0269948 | A1 * | 10/2013 | Hoffman | E21B 33/035 166/351 |
| 2013/0319671 | A1 * | 12/2013 | Lund | E21B 33/13 166/285 |
| 2016/0024874 | A1 * | 1/2016 | Johnson | E21B 43/116 166/297 |

OTHER PUBLICATIONS

Halliburton catalog, p. 3-8, "drillable services tools—EZ Drill SV Squeeze Packer" (undated but admitted to be prior art).

* cited by examiner

DUAL BARRIER PERFORATING SYSTEM

FIELD

This invention relates to tools used in oil and gas wellbores. More specifically, the disclosure relates to barriers or seals used in downhole operations involving activities such as perforating operations and well abandonment operations.

BACKGROUND

Reservoirs of oil or gas in underground formations are typically covered by an impermeable formation, termed caprock, which prevents the oil or gas from migrating to the surface. When a well borehole is drilled to gain access to a prospective production formation or zone, the original natural seal of the caprock is pierced by the borehole. During construction of a well, the drilled borehole is usually cased, such as with steel tubing.

In abandoning the well, the wellbore must be sealed so as to reestablish the impermeability of the caprock to prevent the vertical migration of fluids through the well from the production zone. In order to seal the wellbore, flow of fluids must be addressed both within the casing and within the annulus between the casing outer wall and wellbore. Sealing of the wellbore may need to meet the Bureau of Safety and Environmental Enforcement regulations and/or address other governmental regulations and environmental concerns. Accordingly, new and better methods and systems for sealing abandoned wells are of continuing interest in the oil and gas industry.

BRIEF DESCRIPTION OF THE DRAWINGS

FIGS. 6A and 6B are schematic cross-sectional views illustrating a second stage of introducing a sealing fluid into the borehole through the upper and lower assemblies.

DETAILED DESCRIPTION

Figure 1A:
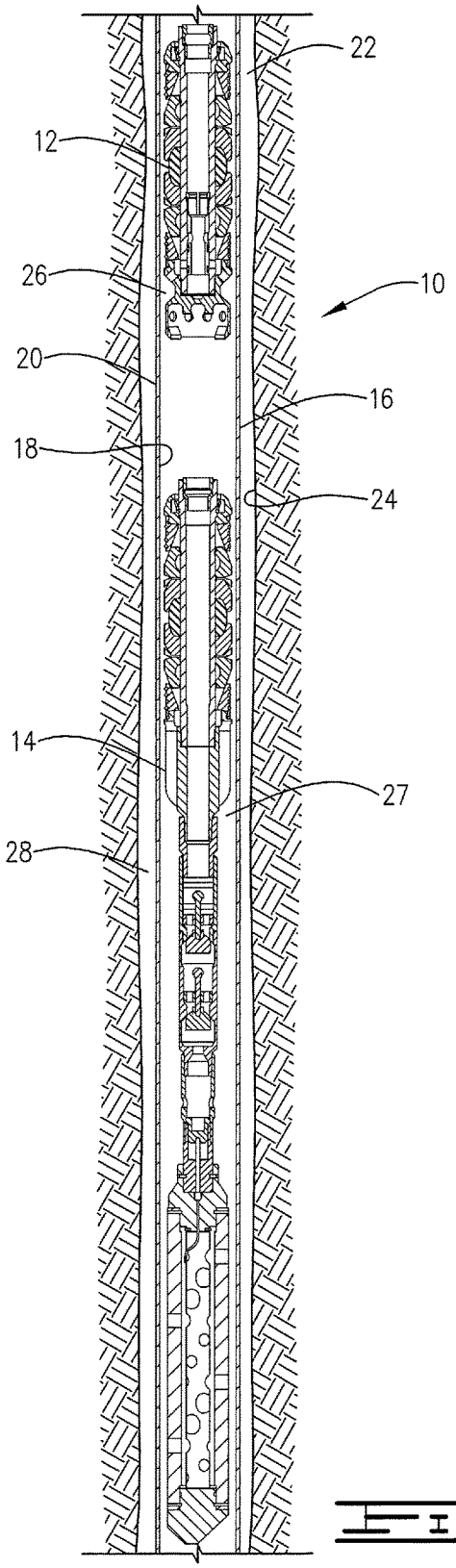
FIG. 1A is a schematic cross-sectional view of upper and lower downhole assemblies useable in an embodiment of the method and system described herein. The assemblies are shown in relation to a borehole and casing.

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. In the following description, the terms "upper," "upward," "lower," "below," "downhole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Generally, this disclosure relates to a process and system for sealing a borehole or wellbore such as when a well is being abandoned at the end of its productive life. The embodiments are particularly applicable to boreholes containing casing with an inner wall and an outer wall wherein an annulus is formed between the outer wall of the casing and the borehole wall. Generally in the process, a first or lower assembly is introduced into the casing at a first setting depth. The lower assembly has a perforating gun and is configured to allow fluid flow only in a direction towards the perforating gun. After the lower assembly reaches the appropriate setting depth, it is moved from an unset position to a set position in which it engages the inner wall of the casing. Next, a second or upper assembly is introduced into the casing at a second setting depth where it is moved from an unset position to a set position in which the second assembly engages the inner wall of the casing.

After both the upper and lower assemblies are set in the casing, fluid pressure is applied through the first and second assemblies to the perforating gun so as to initiate the perforating gun to produce perforations in the casing. The perforations provide fluid access to the annulus between the borehole wall and the casing outer wall. Next, a sealing fluid is introduced through the first and second assemblies into the annulus such that a portion of the sealing fluid remains in the first and second assemblies. The sealing fluid can be a fluid that will transition from a liquid to solid to form a fluid-impermeable plug or barrier. Preferably, the plug will be both liquid and gas impermeable. Typically, the transition will be by drying or crosslinking. Suitable sealing fluids include cements and resins, such as WellLock™ Resin sold by Halliburton.

After the sealing fluid is in place in and below the upper assembly, fluid flow through the upper assembly is prevented, such as by closing a sleeve valve. Thereafter, additional sealing fluid is introduced above the second assembly. By this process, the well is sealed within the annulus between the borehole wall and outer casing wall with the plug formed from the sealing fluid. Additionally, inside the casing is sealed with two mechanical barriers (the upper and lower assemblies) and with a plug formed from the sealing fluid.

Turning now to the figures, embodiments to the current system and process will now be described in more detail. With reference to FIGS. 1A, 1B, 1C and 1D, the structure of one embodiment of the upper and lower assemblies can be seen.

FIG. 1A illustrates a downhole system 10 having an upper assembly 12 and lower assembly 14. Downhole system 10 is shown in relation to a casing 16 in a borehole or well 22. Borehole 22 has a borehole wall 24. Casing 16 has an inner wall 18 and an outer wall 20. Outer wall 20 faces borehole wall 24. Downhole system 10 is received within casing 16 so that upper assembly 12 and lower assembly 14 can be anchored to inner wall 18 in a sealing manner as further described below. In FIG. 1A the upper assembly and lower assembly are not shown as they would be used in the borehole in that neither assembly is in its set position. In other words, neither assembly engages inner wall 18 so as to be anchored thereto or in sealing relation thereto; rather, they are in an unset position, which allows for fluid flow through an annulus between each assembly and inner wall 18. Annulus 26 is between upper assembly 12 and inner wall 18 and annulus 27 is between lower assembly 14 and inner wall 18.

As indicated above, borehole 22 is a cased completion with a casing 16, which during drilling and completion of the well may have been cemented therein. During the productive life of the well, this cement can deteriorate and, accordingly, allow fluid flow in the annulus 28 between outer wall 20 of casing 16 and borehole wall 24. For well abandonment operations, it becomes necessary to insure annulus 28 is sealed against fluid flow. The current system and process provide for this sealing. For ease of illustration, annulus 28 is shown without any cement or other sealant, except where such sealant is added during the current process; however, it should be understood that typically the annulus will have at least some sealant already present.

Figure 1B:
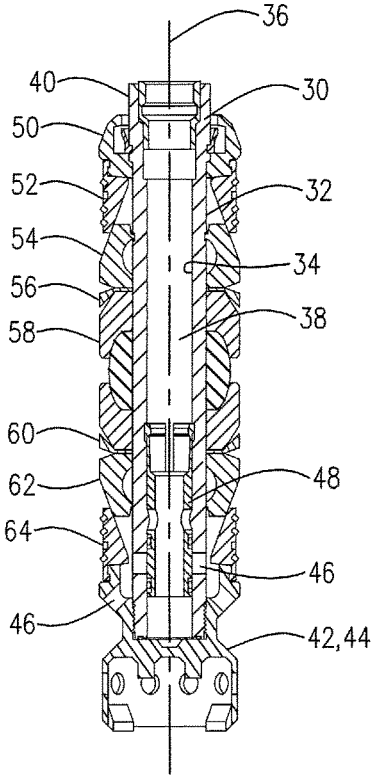
FIG. 1B is an enlargement of the schematic cross-sectional view of the upper assembly illustrated in FIG. 1A.

Turning now to FIG. 1B, upper assembly 12 is illustrated as a packer. Packers typically have at least one means for allowing fluid communication there through. Packers may allow for the controlling of fluid passage by way of one or more valve mechanisms which may be integral to the packer body or which may be externally attached to the packer body. Upper assembly 12 has a packer mandrel 30 having an outer surface 32, an inner surface 34, and a longitudinal central axis or longitudinal axial centerline 36. Also, as referred to herein the term "radially" will refer to a radial direction perpendicular to the longitudinal axial centerline 36 and "longitudinal" or "axial" will refer to a direction parallel to the longitudinal axial centerline 36.

Packer mandrel 30 has central bore 38, an upper end 40 and a lower end 42. Upper end 40 will typically be a "neck", which as used herein means that it is a section that is suitable for connecting to a setting tool, drill string, downhole tubing or other downhole string. Typically, the connection can involve the string engaging into the neck and/or around the outside of the neck. Packer mandrel 30 terminates at its lower end 42 in a shoe 44. Fluid flow through central bore 38 is prevented from coming out the lower end by shoe 44. Mandrel 30 has flow passages 46, which can also extend through shoe 44 as shown. Flow passages 46 are in fluid flow communication with central bore 38 and annulus 26 so that fluid flow through the central bore can pass below upper assembly 12 into the region within casing 16 below upper assembly 12 (see region 118 in FIG. 4A). An inner sleeve valve 48 engages inner surface 34 and can be moved from a closed position to an open position by a setting tool. In the closed position, sleeve valve 48 prevents fluid flow through flow passages 46. In the open position, sleeve valve 48 allows fluid flow through flow passages 46.

Upper assembly 12, which may also be referred to as upper packer assembly 12, includes a sealing and anchoring assembly comprising upper slip ring 52, upper slip wedge 54, upper limiter ring 56, expandable sealing element 58, lower limiter ring 60, lower slip wedge 62 and lower slip ring 64. All of which are positioned circumferentially about packer mandrel 30. A retaining ring 50 adjacent to upper end 40, which can be secured to packer mandrel 30 by pins, provides an abutment serving to axially retain upper slip ring 52 from upward movement. Upper slip ring 52 may be composed of slip segments positioned circumferentially around packer mandrel 30 in order to form the upper slip ring 52. Slip retaining bands can be used to radially retain upper slip ring 52 in an initial circumferential position about packer mandrel 30 as well as upper slip wedge 54. The bands can be made of a steel wire, a plastic material, or a composite material having the requisite characteristics of having sufficient strength to hold the upper slip ring 52 in place prior to actually setting the upper assembly 12. Upper slip wedge 54 is initially positioned in a slidable relationship to, and partially underneath, upper slip ring 52 as shown in FIG. 1B. Examples of suitable slip rings are described in U.S. Pat. No. 5,540,279.

Typically, upper slip wedge 54 will be designed as a partial cone so as to provide a ramp or wedge for splitting and radially expanding upper slip ring 52 when upper assembly 12 is moved into its set position. Upper slip wedge 54 abuts expandable sealing element 58, located below slip wedge 54. An upper limiter ring 56 is positioned at the abutment of upper slip wedge 54 and an expandable sealing element 58 and can be positioned at least partially between them. Upper limiter ring 56 helps limit longitudinal or axial expansion of expandable sealing element 58 when upper assembly 12 is moved into its set position.

Located below upper slip wedge 54 is expandable sealing element 58. The upper assembly 12 includes at least one such expandable sealing element but can include two, three or more such elements. As shown in the figures, it includes three such expandable sealing elements. Expandable sealing element 58 has unset and set positions corresponding to the unset and set positions of upper assembly 12, respectively. Expandable sealing element 58 is radially expandable from the unset position to the set position in response to the application of axial force on expandable sealing element 58. Preferably, in the unset position, expandable sealing element 58 has an unset radius that is less than the outer radius of upper limiter ring 56. Also preferably, in set position, expandable sealing element 58 has a set radius that is greater than outer radius of upper limiter ring 56. In the set position, the expandable sealing element 58 engages inner wall 18 of casing 16 to create a seal to prevent flow through annulus 26 past upper assembly 12.

Upper slip wedge 54 and upper limiter ring 56 are disposed at the upper end of expandable sealing element 58. There is a lower slip wedge 62 and lower limiter ring 60 disposed at the lower end of expandable sealing element 58. Lower slip wedge 62 and lower limiter ring 60 are similar to upper slip wedge 54 and upper limiter ring 56. As shown, the upper end of expandable sealing element 58 resides directly against the abutting ends of upper slip wedge 54 and upper limiter ring 56. Additionally, the lower end of expandable sealing element 58 resides directly against lower slip wedge 62 and lower limiter ring 60. Thus, the upper and lower limiter rings retain the expandable sealing element in the set position and limit extrusion of the expandable sealing element; generally, this will be axial extrusion.

Located below lower slip wedge 62 is lower slip ring 64. Lower slip wedge 62 and lower slip ring 64 are like upper slip wedge 54 and upper slip ring 52. The lower end of lower slip ring 64 abuts shoe 44 so as to be retained from downward axial movement.

Figure 5A:
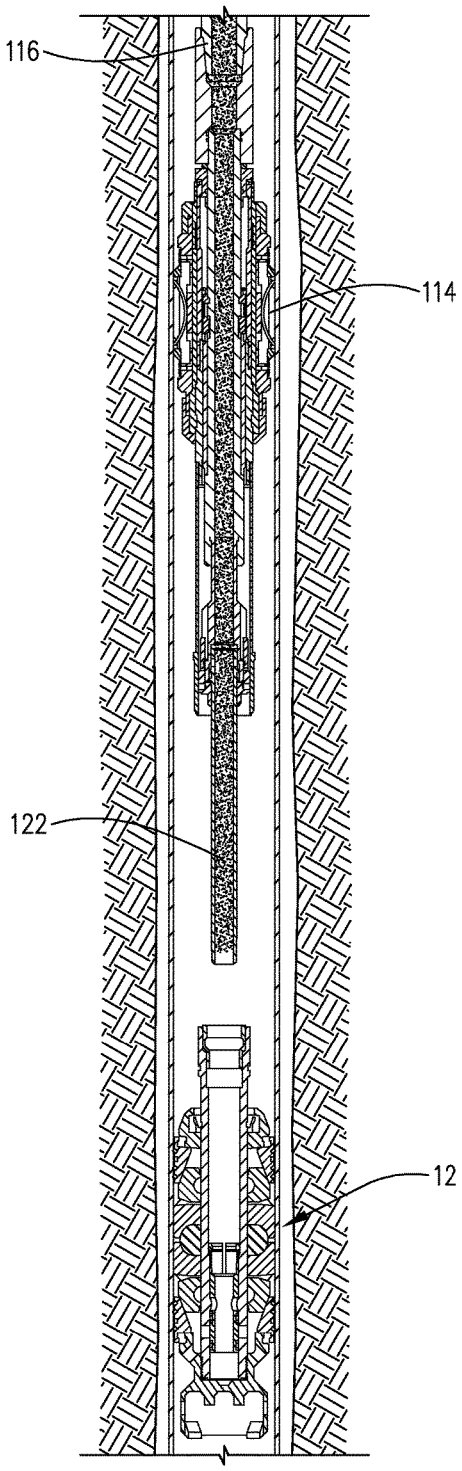
FIGS. 5A and 5B are schematic cross-sectional views illustrating a first stage of introducing a sealing fluid into the borehole through the upper and lower assemblies.

When moved from its unset position to its set position, retaining ring 50 is moved towards shoe 44 shearing any pins restraining retaining ring 50. This movement causes axial pressure to be exerted on the intervening components. Accordingly, upper slip ring 52 is pressed against the wedge surface of upper slip wedge 54 and is thereby radially expanded so that the outer surface of upper slip ring 52 contacts inner wall 18 of casing 16. Similarly, lower slip ring 64 is pressed against the wedge surface of lower slip wedge 62 and is thereby radially expanded so that the outer surface of lower slip ring 64 contacts inner wall 18 of casing 16. Typically, the outer surface of the slip rings will have buttons, wickers or similar that bite into casing 16 and thus anchor upper assembly 12 to casing 16. Also during setting of upper assembly 12, upper slip wedge 54 and lower slip wedge 62 transfer pressure to expandable sealing element 58 causing it to radially expand outward so as to come into sealing engagement with inner wall 18 of casing 16. The sealing engagement prevents fluid flow past upper assembly 12 through annulus 26. FIG. 5A shows upper assembly 12 in its set position.

Figure 1C:
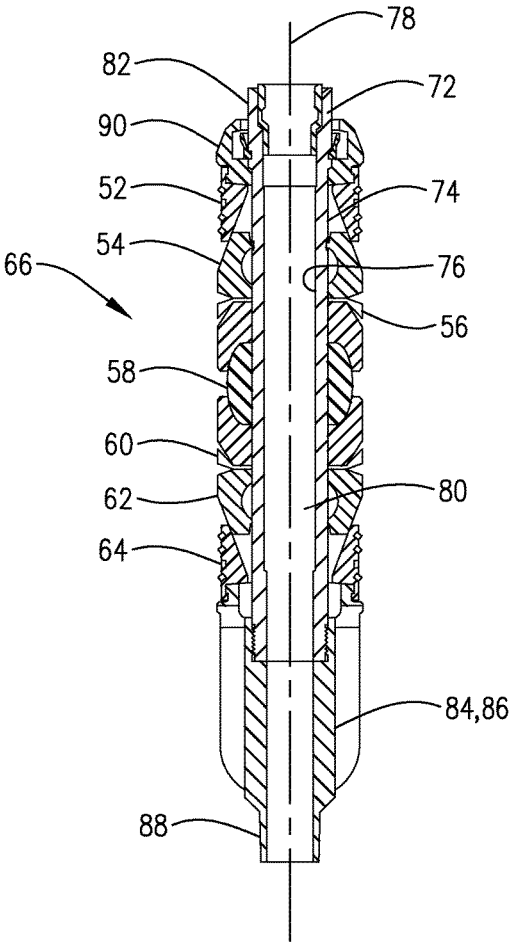
FIG. 1C is an enlargement of the schematic cross-sectional view of the packer section of the lower assembly illustrated in FIG. 1A.
Figure 1D:
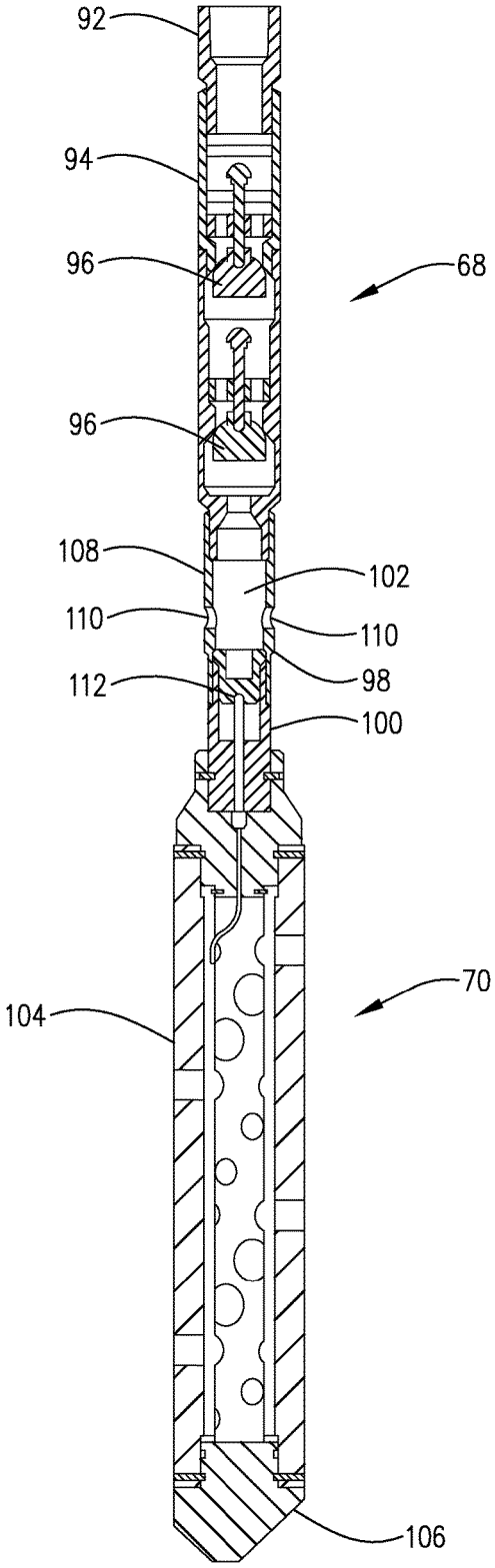
FIG. 1D is an enlargement of the schematic cross-sectional view of the float collar and perforating gun sections of the lower assembly illustrate in FIG. 1A.
Figure 2A:
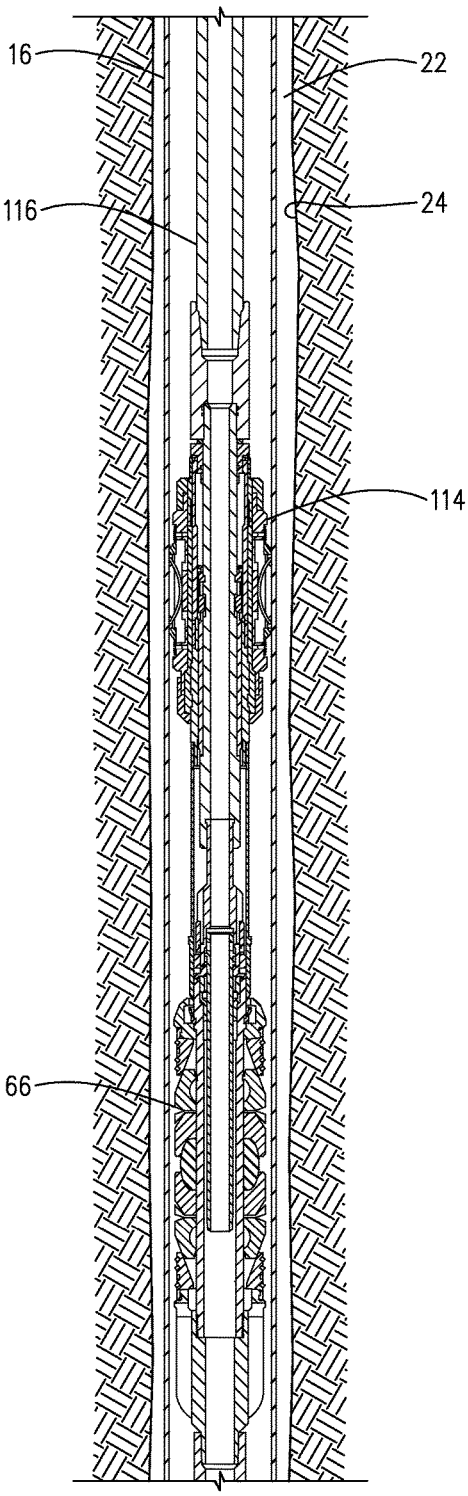
FIGS. 2A and 2B are schematic cross-sectional views of a lower assembly being introduced into a borehole on a setting tool in accordance with one embodiment of the invention.
Figure 2B:
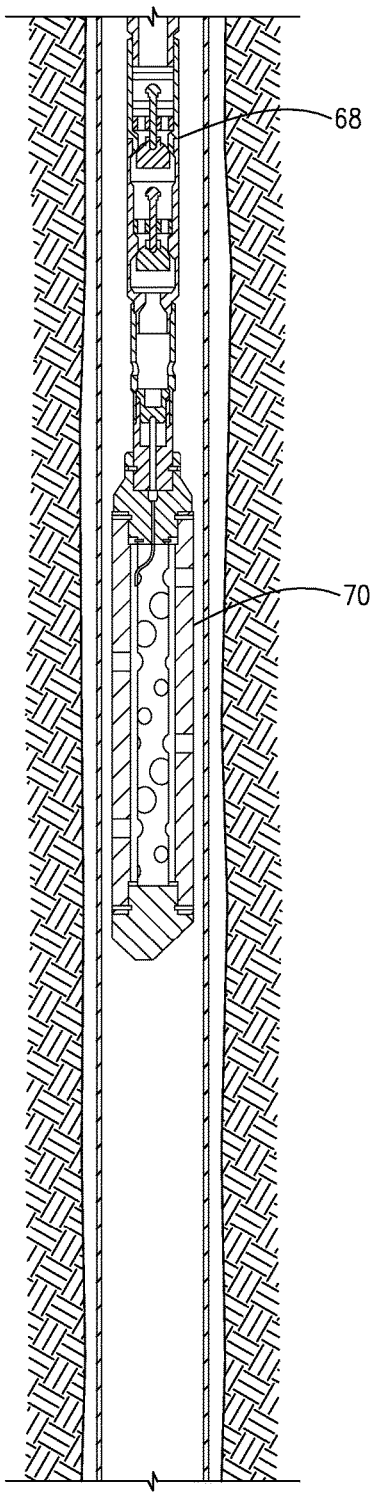

Turning now to FIGS. 1C and 1D, lower assembly 14 will now be described. Lower assembly 14 has a packer section 66 illustrated in FIG. 1C and has a float collar section 68 and a perforating gun section 70 illustrated in FIG. 1D.

Referring first to FIG. 1C, lower assembly 14 has a packer mandrel 72 having an outer surface 74, an inner surface 76, and a longitudinal central axis, or longitudinal axial centerline 78. Also, as referred to herein, the term "radially" will refer to a radial direction perpendicular to the longitudinal axial centerline 78 and "longitudinal" or "axial" will refer to a direction parallel to the longitudinal axial centerline 78.

Packer mandrel 72 has central bore 80, an upper end 82 and a lower end 84. Upper end 82 will typically be a neck, as described above. Packer mandrel 72 terminates at its lower end 84 in a shoe 86. Central bore 80 extends through shoe 86; thus, fluid is allowed to flow through packer section 66 through central bore 80. A lower end 88 of shoe 86 is configured to be attached to an upper end 92 of float collar section 68.

A retaining ring 90 can be positioned adjacent to upper end 82 and can be secured to packer mandrel 72 by pins. Packer section 66 has a sealing and anchoring assembly similar to upper assembly 12 and for which like numbering has been used. Retaining ring 90 provides an abutment serving to axially retain an upper slip ring 52 from upward movement. Shoe 86 provides an abutment serving to axially retain a lower slip ring 64 from downward movement. The operation of the sealing and anchor assembly is as described above for upper assembly 12.

Turning now to FIG. 1D, float collar section 68 has one or more collar housings 94 with one or more check valves 96 positioned therein to provide for one way directional flow of fluid through collar housing 94. An upper end 92 of float collar housing 94 is attached to lower end 88 of shoe 86. Thus, collar housing 94 is in fluid flow communication with central bore 80 of the packer section 66 such that fluid flowing through central bore 80 is introduced into collar housing 94. Check valve 96 allows fluid flow only in a downward direction through collar housing 94 towards perforating gun section 70. A lower end 98 of collar housing 94 is configured to attach to an upper end 100 of perforating gun section 70. Lower end 98 is a ported nipple having a chamber 102 and ports or passages 110. Passages 110 allow downward flowing fluid from float collar section 68 to pass out of the chamber 102 into annulus 27 and, hence, into the interior of casing 16. Chamber 102 serves as a detonation chamber 102, as further described below.

Perforating gun section 70 comprises upper end 100, a perforating gun 104 and a lower end 106. Upper end 100 is connected to lower end 98 of collar housing 94. Additionally, upper end 100 has a detonator 112 which can be in fluid flow communication with detonation chamber 102. Detonator 112 detonates perforating gun 104. Detonator 112 can be a pressure detonator that detonates perforating gun 104 when the fluid pressure within detonation chamber 102 reaches a predetermined pressure. When detonated, the explosive energy, gases and emissions from perforation gun 104 are directed outward towards the casing and thereby perforate or fracture casing 16 causing holes therein through which fluid can flow into annulus 28 between casing 16 and borehole wall 24. Perforating gun 104 can be any suitable perforating gun as known in the art.

Mandrels 30 and 72, slip wedges 54 and 62, and slip rings 52 and 64 can be composed of any material with a suitable pressure rating. Typically, these components can be made of steel. Expandable sealing element 58 can be comprised of elastomeric material such as for example elastomers sold under the trademarks VITON or FKM (Vicon). The examples provided herein are non-limiting.

Turning now to FIGS. 2 through 8, the process of sealing a well, such as in abandonment operations, will now be described in relation to using the above described system. As illustrated in FIGS. 2A and 2B, lower assembly 14 is attached to a setting tool 114 and then introduced downhole. As shown, setting tool 114 is a mechanical setting tool, which are known in the art. Lower assembly 14 is lowered downhole until it reaches a predetermine position or setting depth, typically at or above the top of the production reservoir, which is being abandoned. As it is being lowered into position, the lower assembly 14 is in an unset position. Upon reaching the predetermined position within borehole 22, packer section 66 of lower assembly 14 is moved to its set position, as can be seen from FIG. 3B. In its set position, slip rings 52 and 64 are expanded to engage casing 16 to anchor lower assembly 14 in place. Additionally in its set position, expandable sealing element 58 is in sealing contact with inner wall 18 of casing 16 thus preventing fluid flow in annulus 27 past packer section 66.

Figure 3A:
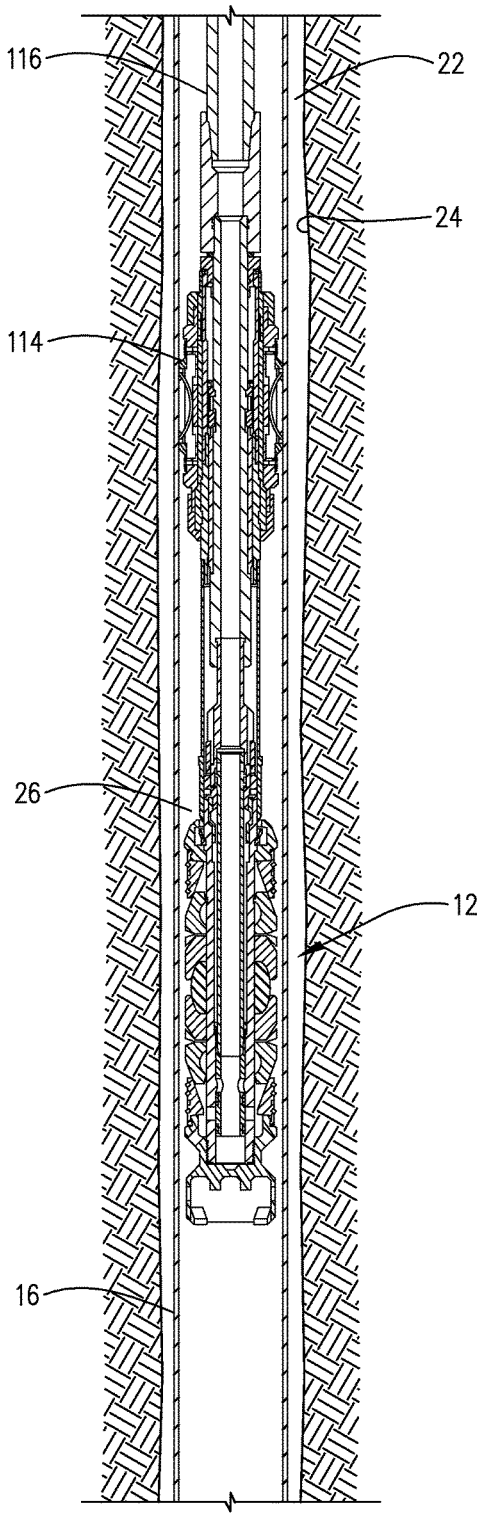
FIGS. 3A and 3B are schematic cross-sectional views of an upper assembly being introduced into a borehole on a setting tool after the introduction of the lower assembly as illustrated in FIGS. 2A and 2B.
Figure 3B:
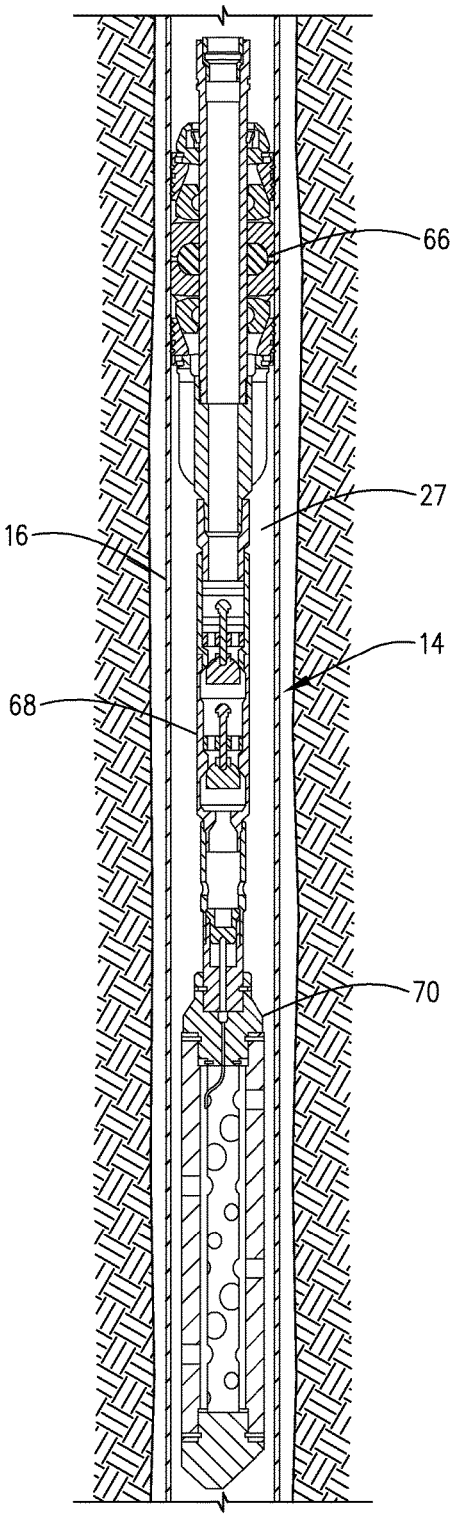

With reference to FIGS. 3A and 3B, once lower assembly 14 is set in position, setting tool 114 is disconnected and taken back up hole where it is connected to upper assembly 12. Upper assembly 12 is then introduced downhole and lowered into a position above lower assembly 14. For example, upper assembly 12 can be lowered to a predetermined position or setting depth so that lower end 42 of upper assembly 12 is five to ten feet above the upper end 82 of lower assembly 14. As it is being lowered into position, the upper assembly 12 is in an unset position. Upon reaching the appropriate position within borehole 22, upper assembly 12 is moved to its set position, as can be seen from FIGS. 4A and 5A. In its set position, slip rings 52 and 64 are expanded to engage casing 16 to anchor upper assembly 12 in place. Additionally in its set position, expandable sealing element 58 is in sealing contact with inner wall 18 of casing 16 thus preventing fluid flow in annulus 26 past upper assembly 12.

Figure 4A:
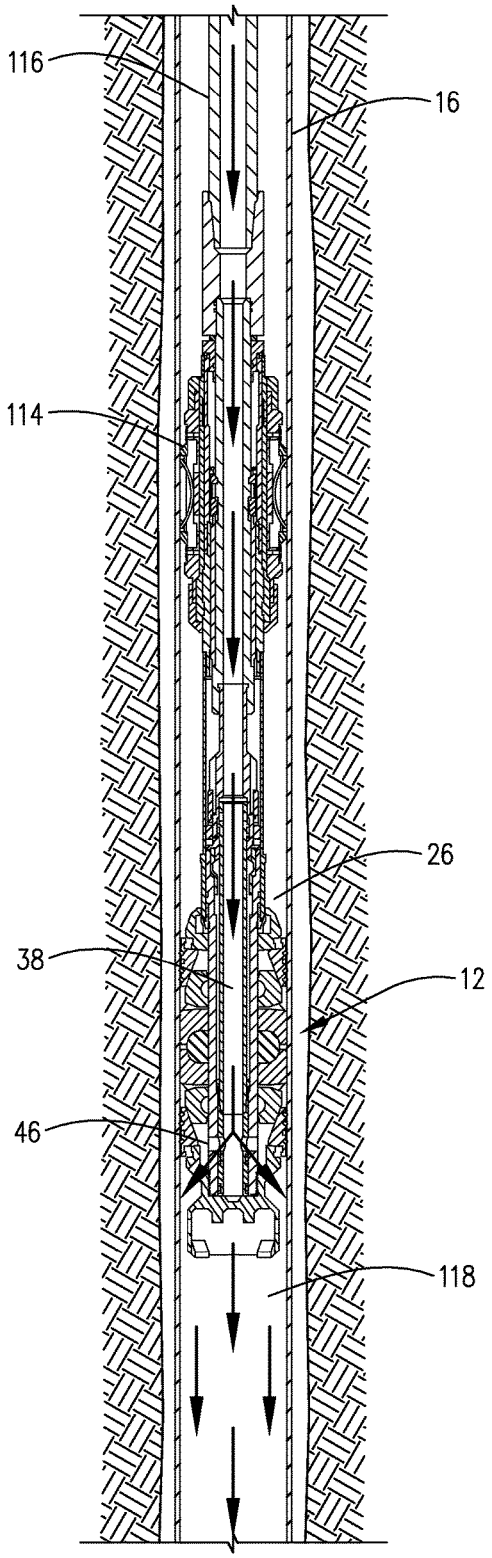
FIGS. 4A and 4B are schematic cross-sectional views illustrating the flow path of fluid through the upper and lower assemblies after they have been set in the borehole.
Figure 4B:
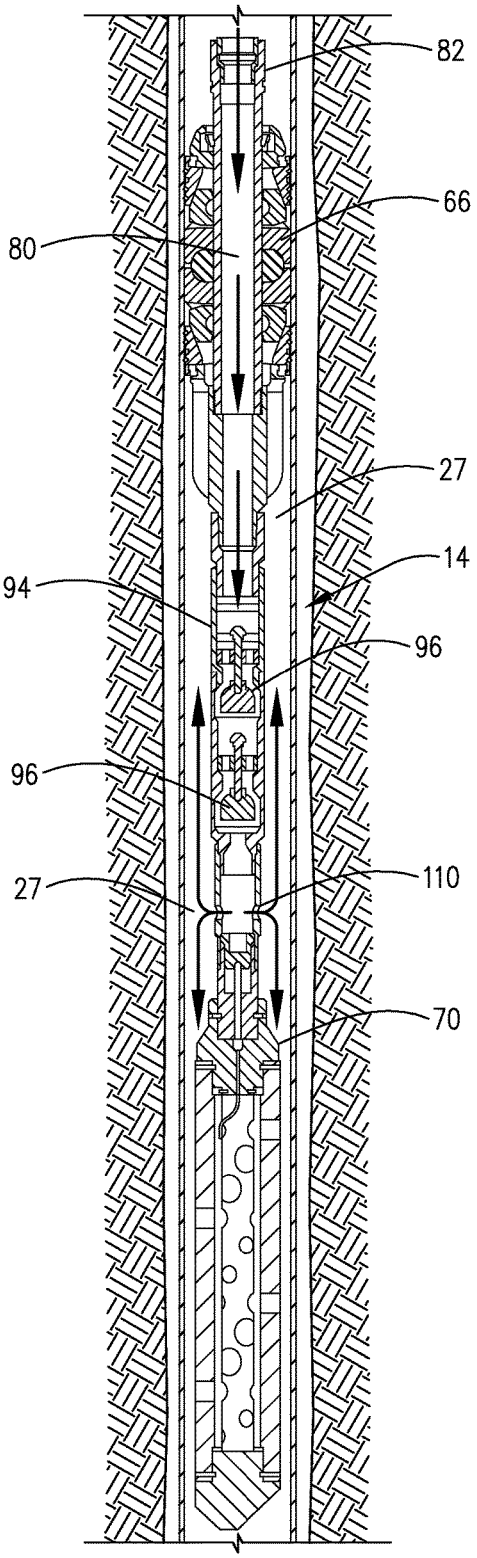

Turning now to FIGS. 4A and 4B, the flow path of fluid through the downhole system 10 is illustrated. When upper assembly 12 and lower assembly 14 have been set in the casing and setting tool 114 engages upper assembly 12 so that sleeve valve 48 is in its open position then the flow path is as shown in FIGS. 4A and 4B. Fluid flows downhole through the tool string 116 and setting tool 114 to enter central bore 38 of upper assembly 12. Sleeve valve 48 is in its open position thus the fluid flows out of central bore 38 through flow passages 46 and into interior region 118 of casing 16 between upper assembly 12 and lower assembly 14. Because upper assembly 12 is in its set position, fluid cannot flow back up hole through annulus 26. The fluid instead enters central bore 80 of the packer section 66 through the upper end 82. The fluid flows through packer section 66 of lower assembly 14 and enters collar housing 94. Check valves 96 in collar housing 94 allows the fluid to flow downward through collar housing 94 and out through passages 110 where it can enter annulus 27. When the setting tool does not engage upper assembly 12 so as to place sleeve valve 48 in its open position, fluid flow through upper assembly 12 is not allowed and, hence, is not passed through upper assembly 12 to lower assembly 14.

When activation of the perforation gun is desired, the setting tool is engaged with upper assembly 12 so as to place sleeve valve 48 in its open position and fluid flow through the downhole system as described above is commenced. The fluid pressure is increased to a predetermined pressure sufficient to activate detonator 112 thus firing perforating gun 104 so as to produce perforations 120 in the casing (see FIG. 5B). Perforations 120 provide fluid access to annulus 28 between the borehole wall 24 and the casing outer wall 20.

Figure 5B:
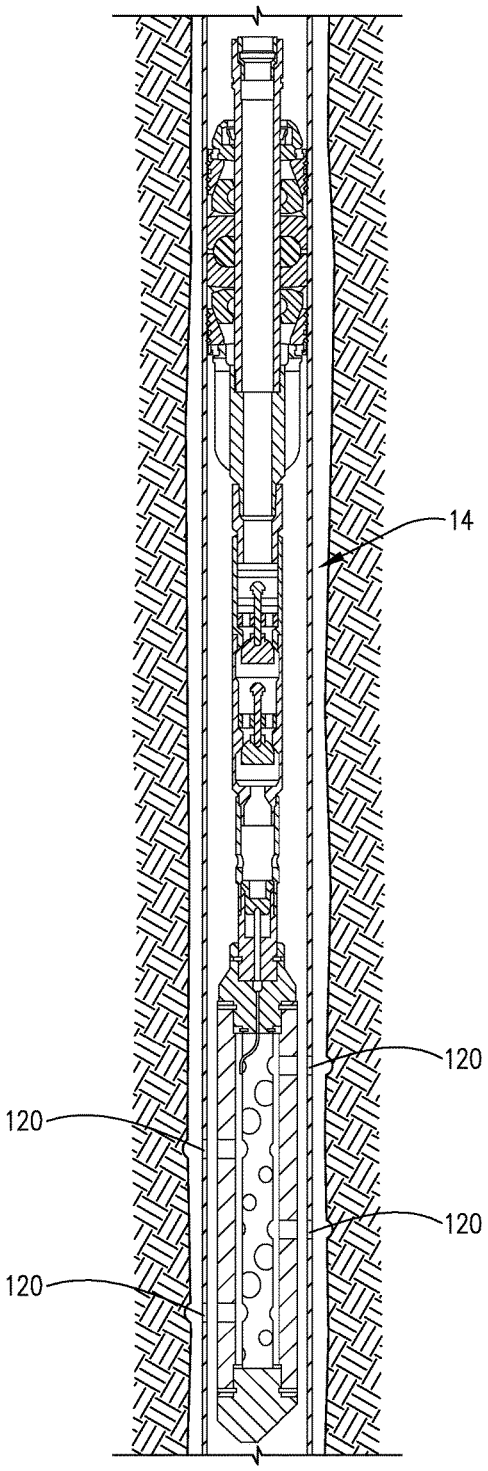

Turning now to FIGS. 5A and 5B, setting tool 114 is disengaged from upper assembly 12 after perforations 120 are created. Typically, sleeve valve 48 will thus be placed in its closed position. Next, a sealing fluid 122 is allowed to circulate through the tool string and setting tool. Sealing fluid 122 displaces the downhole fluid used to activate the perforating gun. Since sleeve valve 48 is closed, this downhole fluid cannot flow past upper assembly 12 and, thus flows back up the borehole to be recovered at the surface.

Turning now to FIGS. 6A and 6B, setting tool 114 is engaged with upper assembly 12 so as to open sleeve valve 48, after sealing fluid 122 has displaced the drilling fluid in setting tool 114. Thus, sealing fluid 122 is introduced through upper assembly 12 into interior region 118 and then into and through packer section 66. Sealing fluid 122 is flowing downward and thus check valves 96 allow its passage through float collar housing 92 and into detonation chamber 102.

Figure 7A:
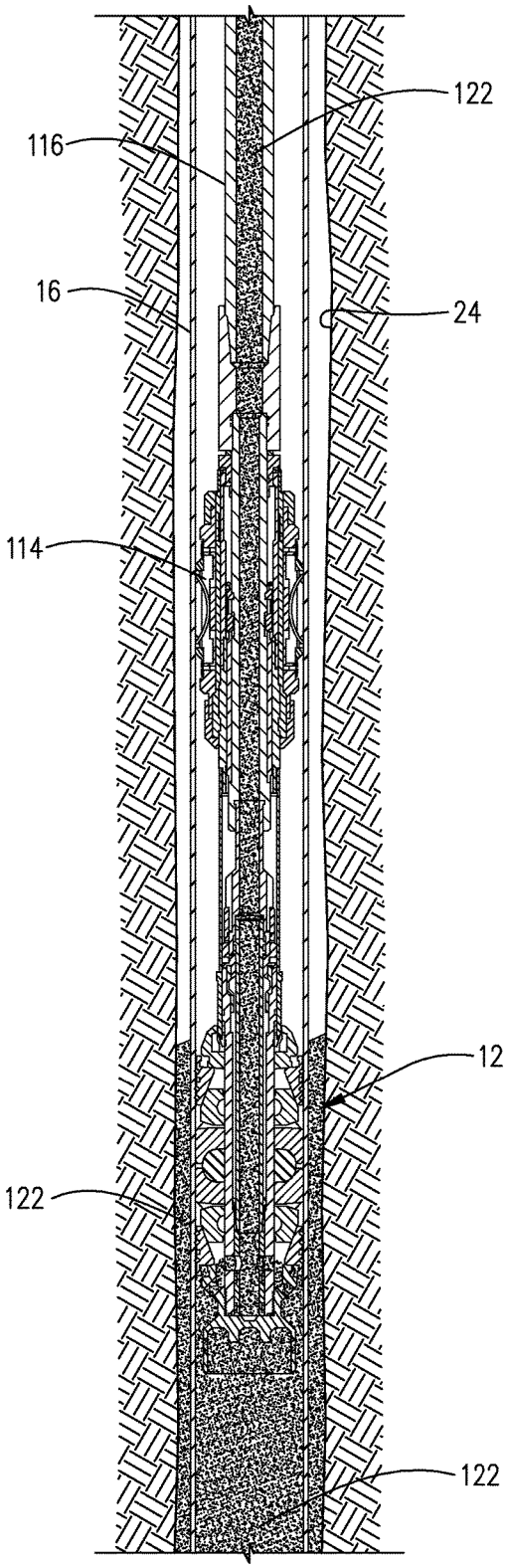
FIGS. 7A and 7B are schematic cross-sectional views illustrating a third stage of introducing a sealing fluid into the borehole through the upper and lower assemblies.
Figure 7B:
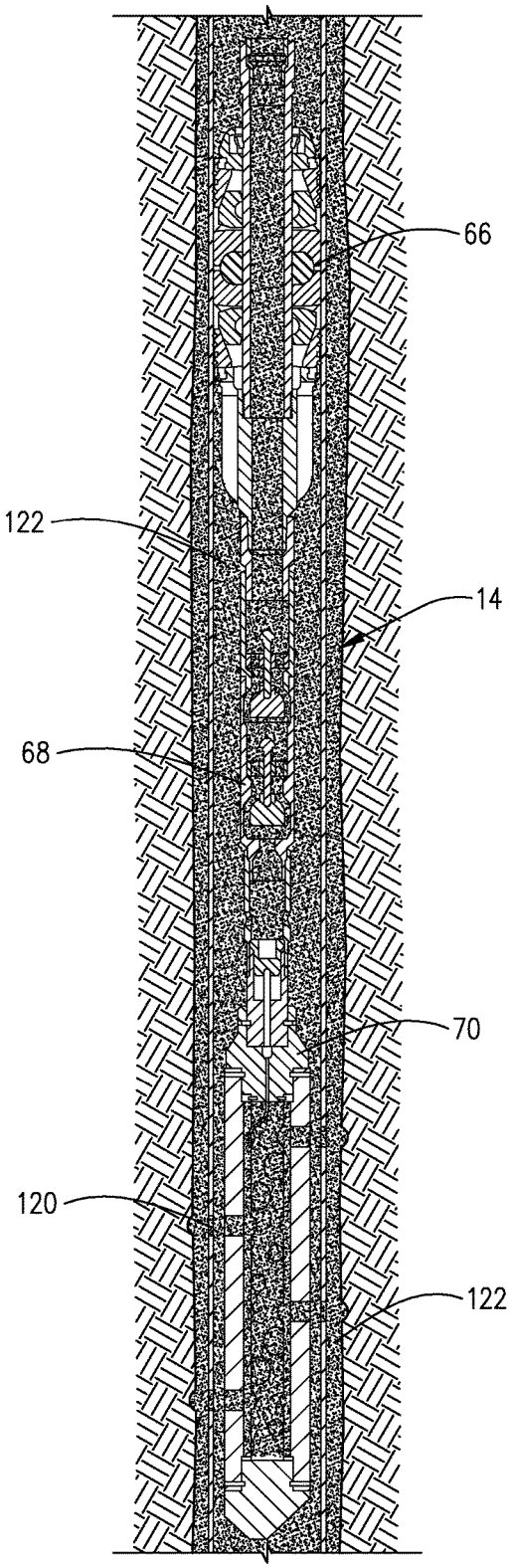
Figure 8A:
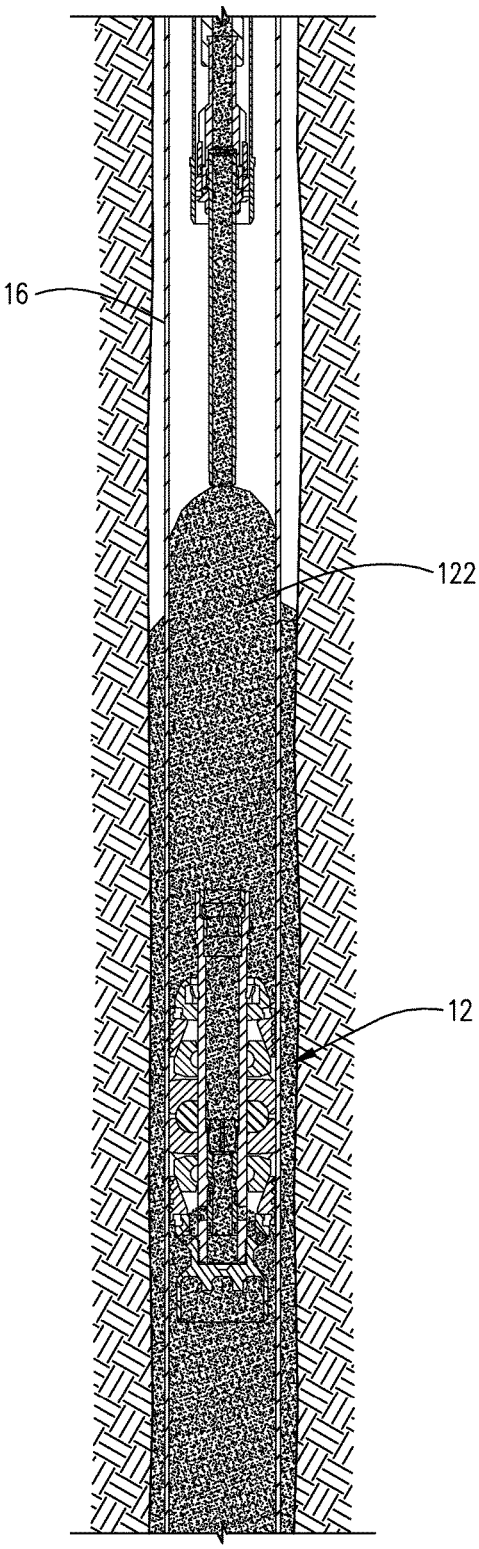
Figure 8B:
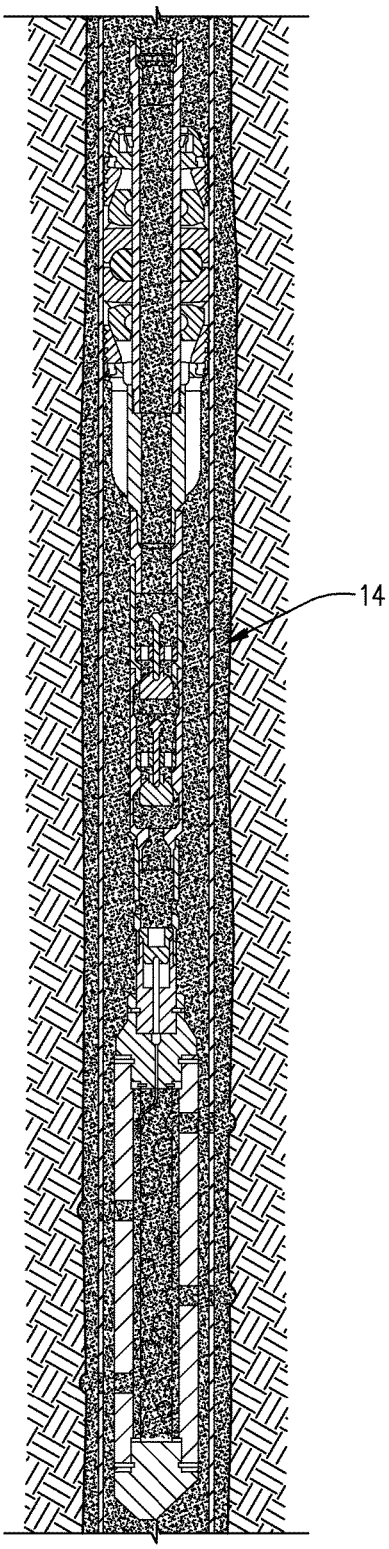

Turning now to FIGS. 7A and 7B, the continued introduction of sealing fluid 122 results in it flowing through passages 110 of detonation chamber 102. Thus, sealing fluid 122 is introduced to annulus 27 and into any voids in perforating gun 104. Additionally, sealing fluid in annulus 27 flows through perforations 120 so as to be introduced into annulus 28 between the casing 16 and borehole wall 24. The sealing fluid will flow upward in annulus 28 as allowed by any voids therein. Preferably, sealing fluid 122 is introduced such that upper assembly 12, interior region 118, lower assembly 14 and annulus 27 are substantially full of sealing fluid 122. Preferably, annulus 28 is substantially full of sealing fluid at least in the region extending from upper assembly 12 to the lower end 106 of lower assembly 14. More typically, annulus 28 will have sealing fluid to a level above upper assembly 12 (see FIG. 8A). The sealing fluid can be a fluid that will transition from a liquid to solid to form a fluid-impermeable plug or barrier. Preferably, the plug will be both liquid and gas impermeable. Typically, the transition will be by drying or crosslinking. Suitable sealing fluids include cements and resins, such as WellLock™ Resin sold by Halliburton.

Figure 8A:
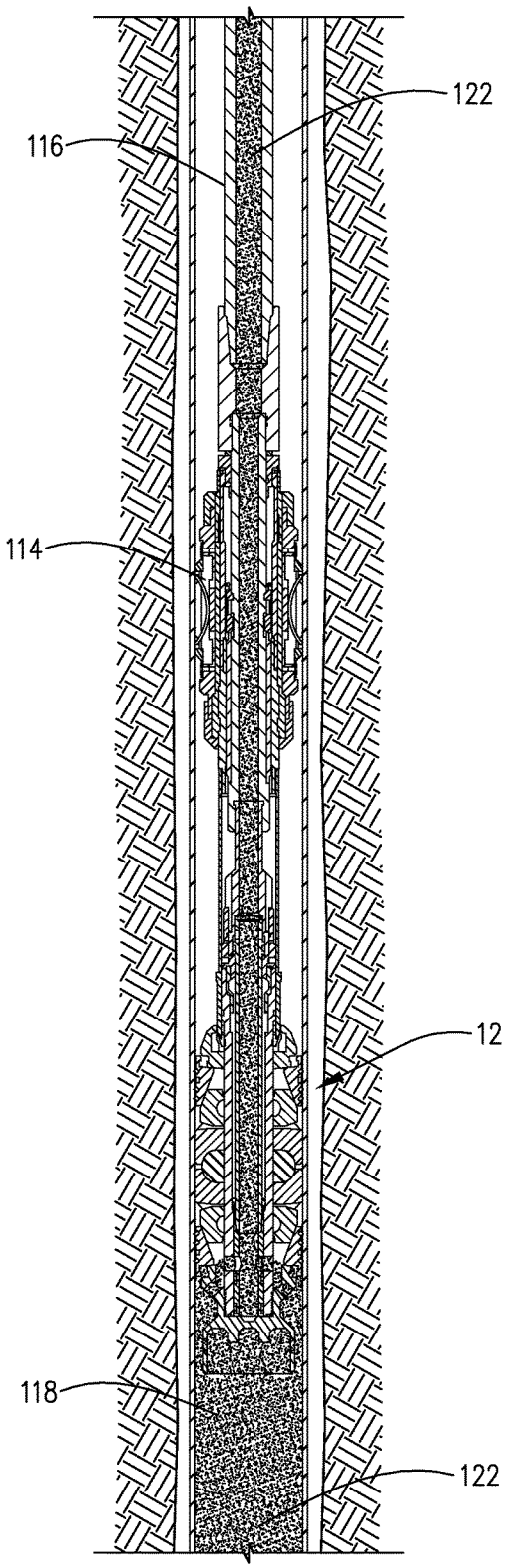
FIGS. 8A and 8B are schematic cross-sectional views illustrating a fourth stage of introducing a sealing fluid into the borehole through the upper and lower assemblies.
Figure 8B:
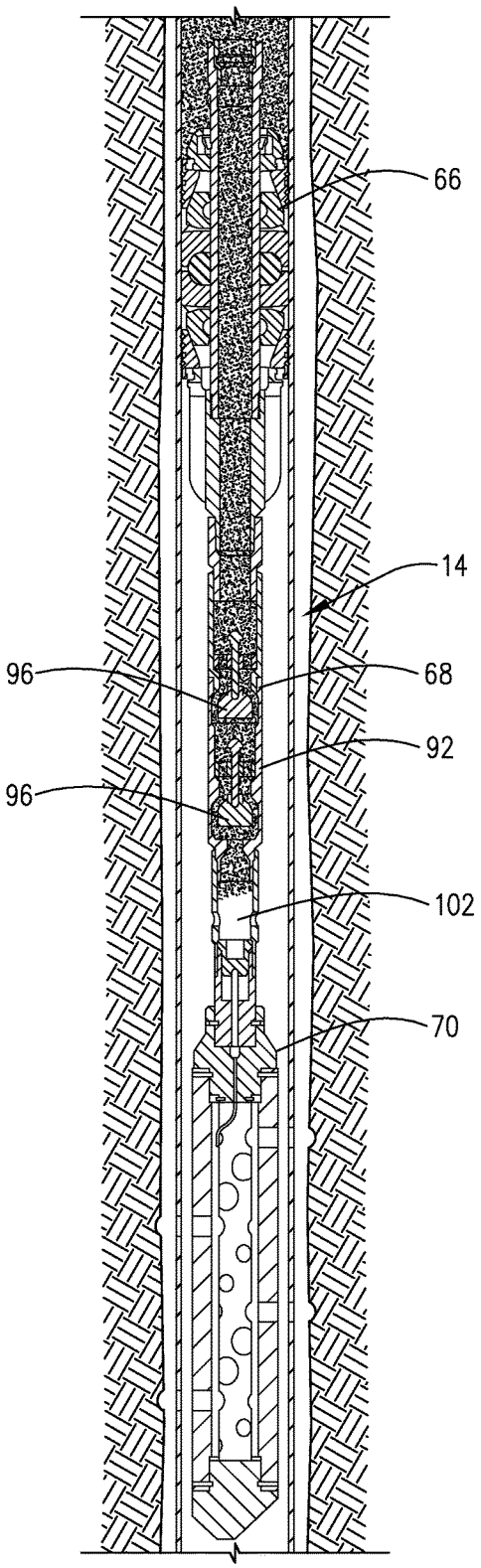

Turning now to FIGS. 8A and 8B, after the sealing fluid is in place in and below upper assembly 12, setting tool 114 is disengaged from upper assembly 12 thus closing sleeve valve 48 and preventing fluid flow through upper assembly 12. Thereafter, additional sealing fluid 122 is introduced above upper assembly 12 within casing 16 as shown in FIG. 8A. By this process, the well is sealed within annulus 28 between the borehole wall 24 and casing outer wall 20 with a plug formed from sealing fluid 122. Additionally, inside casing 16 is sealed with two mechanical barriers (the upper assembly 12 and lower assembly 14) and with a plug formed from sealing fluid 122.

More generally, in one embodiment of the invention there is a process for sealing a borehole having a borehole wall. The borehole contains a casing with an inner wall and an outer wall wherein an annulus is formed between the outer wall and the borehole wall. The process comprises the steps of:

a. introducing into the casing a first assembly at a first setting depth, the first assembly having a perforating gun and configured to allow fluid flow through the first assembly only in a direction towards the perforating gun;
b. moving the first assembly from an unset position to a set position in which it engages the inner wall of the casing;
c. introducing into the casing a second assembly at a second setting depth;
d. moving the second assembly from an unset position to a set position in which the second assembly engages the inner wall of the casing;
e. applying fluid pressure through the first and second assemblies to the perforating gun so as to initiate the perforating gun to produce perforations in the casing;
f. introducing a sealing fluid through the first and second assemblies into the annulus such that a portion of the sealing fluid remains in the first and second assemblies;
g. preventing fluid flow through the second assembly; and
h. thereafter, introducing additional sealing fluid above the second assembly.

Additionally, in the process first assembly can be a first packer assembly comprising a first mandrel, a first sealing assembly, a perforating gun, a float collar and a ported nipple. The first mandrel defines a first central flow passage. The mandrel has a first neck. The first sealing assembly can be disposed about the first mandrel. The first sealing assembly is radially expandable from an unset position to a set position in response to application of axial force on the first sealing assembly. The first sealing assembly engages the casing in the set position. The float collar is positioned between the first mandrel and the perforating gun at the distal end of the mandrel from the neck. The float collar provides for one directional flow of fluid towards the perforating gun. The ported nipple is positioned between the float collar and the perforation gun for conveying fluid to and around the perforating gun.

Also, in the process the second assembly can be a second packer assembly comprising a second mandrel, an opening sleeve, and a second sealing assembly. The second mandrel defines a second central flow passage and has at least one fluid port through a wall thereof. The second mandrel has a second neck. The opening sleeve is positioned in the second mandrel and is movable from a closed position, in which the opening sleeve covers the fluid port and prevents fluid flow through the second mandrel, to an open position, in which the fluid port is not covered by the opening sleeve and fluid flow through the second mandrel is allowed. The second sealing assembly is disposed about the second mandrel. The second sealing assembly is radially expandable from an unset position to a set position in response to application of axial force on the second sealing assembly. The second sealing assembly engages the casing in the set position.

In the process the first assembly, second assembly, first packer assembly and/or second packer assembly can be introduced into the casing by a setting tool.

Further, the above described process, and each variation thereof, can further comprise, after step e and before step f, the steps of:

moving the sleeve to the closed position;

disengaging the setting tool from the second packer assembly;

circulating sealing fluid through the setting tool;

engaging the setting tool with the second packer assembly; and moving the sleeve to the open position.

In another embodiment, there is provided a system for sealing a borehole having a borehole wall. The borehole contains a casing with an inner wall and an outer wall. An annulus is formed between the outer wall and the borehole wall. The system comprises a first packer assembly and a second packer assembly. The first packer assembly is positioned within the casing. The first packer assembly having a perforating gun and configured to provide for one directional flow of fluid within the casing towards the perforating gun. The second packer assembly is positioned within the casing above the first packer assembly. The second packer assembly is configured to have an open configuration in which fluid flow within the casing and towards the first packer assembly is allowed and to have a closed configuration in which fluid flow within the casing and towards the first packer assembly is prevented.

The system can further comprise a setting tool configured to move the second packer assembly from the open configuration to the closed configuration.

The first packer assembly can have a first mandrel, a first sealing assembly, a perforating gun, a float collar and a ported nipple. The first mandrel defines a first central flow passage. The first mandrel has a first neck. The first sealing assembly is disposed about the first mandrel. The first sealing assembly is radially expandable from an unset position to a set position in response to application of axial force on the first sealing assembly. The first sealing assembly engages the casing in the set position. The float collar is positioned between the first mandrel and the perforating gun at the distal end of the mandrel from the neck. The float collar provides for one directional flow of fluid towards the perforating gun. The ported nipple is positioned between the float collar and the perforation gun for conveying fluid to and around the perforating gun.

The second packer assembly can have a second mandrel, an opening sleeve and a second sealing assembly. The second mandrel defines a second central flow passage and has at least one fluid port through a wall thereof. The second mandrel can have a second neck. The opening sleeve is positioned in the second mandrel and is movable from a closed position, in which the opening sleeve covers the fluid port and prevents fluid flow through the second mandrel, to an open position, in which the fluid port is not covered by the opening sleeve and fluid flow through the second mandrel is allowed. The second sealing assembly can be disposed about the second mandrel. The second sealing assembly is radially expandable from an unset position to a set position in response to application of axial force on the second sealing assembly. The second sealing assembly engages the casing in the set position.

The setting tool can be configured to attach to the neck of the first and second sealing assemblies and to move them from their unset positions to their set positions. Further, the setting tool can be configured to open and close the opening sleeve.

The system can also be configured so that a fluid pressure can be applied through the first and second mandrels to the perforating gun so as to initiate the perforating gun to produce perforations in the casing. Also, the system can be further configured so that, after the perforations have been produce, a sealing fluid can be introduced through the first and second mandrels into the annulus such that a portion of the sealing fluid remains in the first and second mandrels. Additionally, the system can be configured such that the opening sleeve can be moved to the closed position after the introduction of the sealing fluid so that the system further comprises sealing fluid in the annulus, in the first and second mandrels and above the second packer assembly.

Other embodiments will be apparent to those skilled in the art from a consideration of this specification or practice of the embodiments disclosed herein. Thus, the foregoing specification is considered merely exemplary with the true scope thereof being defined by the following claims.

What is claimed is:

1. A process for sealing a borehole having a borehole wall, said borehole containing a casing with an inner wall and an outer wall wherein an annulus is formed between said outer wall and said borehole wall, the process comprising:

a. introducing into said casing a first assembly at a first setting depth, said first assembly having a perforating gun and configured to allow fluid flow through said first assembly only in a direction towards said perforating gun;

b. moving said first assembly from an unset position to a set position in which it engages said inner wall of said casing;

c. introducing into said casing a second assembly at a second setting depth;

d. moving said second assembly from an unset position to a set position in which said second assembly engages said inner wall of said casing;

e. applying fluid pressure through said first and second assemblies to said perforating gun so as to initiate said perforating gun to produce perforations in said casing;

f. introducing a sealing fluid through said first and second assemblies into said annulus such that a portion of said sealing fluid remains in said first and second assemblies;

g. preventing fluid flow through said second assembly; and h. thereafter, introducing additional sealing fluid above said second assembly.

2. The process of claim 1 wherein said first assembly is a first packer assembly comprising:

a first mandrel defining a first central flow passage, said mandrel having a first neck;

a first sealing assembly disposed about said first mandrel, wherein said first sealing assembly is radially expandable from an unset position to a set position in response to application of axial force on said first sealing assembly and wherein said first sealing assembly engages said casing in said set position;

a perforating gun;

a float collar positioned between said first mandrel and said perforating gun at the distal end of said mandrel from said neck, said float collar providing for one directional flow of fluid towards said perforating gun; and a ported nipple positioned between said float collar and said perforation gun for conveying fluid to and around said perforating gun.

3. The process of claim 2 wherein said first packer assembly is introduced into said casing by a setting tool.

4. The process of claim 1 wherein said second assembly is a second packer assembly comprising:

a second mandrel defining a second central flow passage and having at least one fluid port through a wall thereof, said second mandrel having a second neck;

an opening sleeve positioned in said second mandrel movable from a closed position, in which said opening sleeve covers said fluid port and prevents fluid flow through said second mandrel, to an open position, in which said fluid port is not covered by said opening sleeve and fluid flow through said second mandrel is allowed;

a second sealing assembly disposed about said second mandrel, wherein said second sealing assembly is radially expandable from an unset position to a set position in response to application of axial force on said second sealing assembly and wherein said second sealing assembly engages said casing in said set position.

5. The process of claim 4 wherein said second packer assembly is introduced into said casing by a setting tool.

6. The process of claim 5 further comprising, after step e and before step f, the steps of:

moving said sleeve to said closed position;

disengaging said setting tool from said second packer assembly;

circulating sealing fluid through said setting tool;

engaging said setting tool with said second packer assembly; and moving said sleeve to said open position.

7. The process of claim 6 wherein said first assembly is a first packer assembly comprising:

a first mandrel defining a first central flow passage, said mandrel having a first neck;

a first sealing assembly disposed about said first mandrel, wherein said first sealing assembly is radially expandable from an unset position to a set position in response to application of axial force on said first sealing assembly and wherein said first sealing assembly engages said casing in said set position;

a perforating gun;

a float collar positioned between said first mandrel and said perforating gun at the distal end of said mandrel from said neck, said float collar providing for one directional flow of fluid towards said perforating gun; and a ported nipple positioned between said float collar and said perforation gun for conveying fluid to and around said perforating gun.

8. A process for sealing a borehole having a borehole wall, said borehole containing a casing with an inner wall and an outer wall wherein an annulus is formed between said outer wall and said borehole wall, the process comprising:

a. introducing into said casing a first packer assembly at a first setting depth, wherein said first packer is introduced by a setting tool and said first packer assembly has:

a first mandrel defining a first central flow passage, said mandrel having a first neck;

a first sealing assembly disposed about said first mandrel, wherein said first sealing assembly is radially expandable from an unset position to a set position in response to application of axial force on said first sealing assembly and wherein said first sealing assembly engages said casing in said set position;

a perforating gun;

a float collar positioned between said first mandrel and said perforating gun at the distal end of said mandrel from said neck, said float collar providing for one directional flow of fluid towards said perforating gun; and a ported nipple positioned between said float collar and said perforation gun for conveying fluid to and around said perforating gun;

b. moving said first sealing assembly from said unset position to a set position;

c. releasing said setting tool from said first packer assembly;

d. introducing into said casing a second packer assembly at a second setting depth, wherein said first packer is introduced by said setting tool and said second packer assembly having:

a second mandrel defining a second central flow passage and having at least one fluid port through a wall thereof, said second mandrel having a second neck;

an opening sleeve positioned in said second mandrel movable from a closed position, in which said opening sleeve covers said fluid port and prevents fluid flow through said second mandrel, to an open position, in which said fluid port is not covered by said opening sleeve and fluid flow through said second mandrel is allowed; and a second sealing assembly disposed about said second mandrel, wherein said second sealing assembly is radially expandable from an unset position to a set position in response to application of axial force on said second sealing assembly and wherein said second sealing assembly engages said casing in said set position;

e. moving said second sealing assembly from said unset position to a set position with said opening sleeve in said open position;

f. applying fluid pressure through said first and second mandrels to said perforating gun so as to initiate said perforating gun to produce perforations in said casing;

g. moving said sleeve to said closed position;

h. disengaging said setting tool from said second packer assembly;

i. circulating sealing fluid through said setting tool;

j. engaging said setting tool with said second packer assembly;

k. moving said sleeve to said open position;

l. introducing a sealing fluid through said first and second mandrels into said annulus such that a portion of said sealing fluid remains in said mandrels;

m. moving said opening sleeve to said closed position; and n. thereafter, introducing additional sealing fluid above said second packer assembly.

9. A system for sealing a borehole having a borehole wall, said borehole containing a casing with an inner wall and an outer wall wherein an annulus is formed between said outer wall and said borehole wall, the system comprising:

a first packer assembly positioned within said casing, said first packer assembly having a perforating gun and configured to provide for one directional flow of fluid within said casing towards said perforating gun and having:

a second packer assembly positioned above said first packer assembly within said casing, said second packer assembly configured to have an open configuration in which fluid flow within said casing and towards said first packer assembly is allowed and to have a closed configuration in which fluid flow within said casing and towards said first packer assembly is prevented.

10. The system of claim 9 further comprising a setting tool configured to move said second packer assembly from said open configuration to said closed configuration.

11. The system of claim 10 wherein said first packer assembly further comprises:

a first mandrel defining a first central flow passage, said mandrel having a first neck;

a first sealing assembly disposed about said first mandrel, wherein said first sealing assembly is radially expandable from an unset position to a set position in response to application of axial force on said first sealing assembly and wherein said first sealing assembly engages said casing in said set position;

a float collar positioned between said first mandrel and said perforating gun at the distal end of said mandrel from said neck, said float collar providing for one directional flow of fluid towards said perforating gun; and a ported nipple positioned between said float collar and said perforation gun for conveying fluid to and around said perforating gun.

12. The system of claim 11 wherein said second packer assembly comprises:

a second mandrel defining a second central flow passage and having at least one fluid port through a wall thereof, said second mandrel having a second neck;

an opening sleeve positioned in said second mandrel movable from a closed position, in which said opening sleeve covers said fluid port and prevents fluid flow through said second mandrel, to an open position, in which said fluid port is not covered by said opening sleeve and fluid flow through said second mandrel is allowed;

a second sealing assembly disposed about said second mandrel, wherein said second sealing assembly is radially expandable from an unset position to a set position in response to application of axial force on said second sealing assembly and wherein said second sealing assembly engages said casing in said set position.

13. The system of claim 12 wherein said setting tool is further configured to move said first and second sealing assemblies from their unset positions to their set positions and configured to open and close said opening sleeve.

14. The system of claim 13 wherein said system is configured so that a fluid pressure can be applied through said first and second mandrels to said perforating gun so as to initiate said perforating gun to produce perforations in said casing.

15. The system of claim 14 wherein said system is further configured so that, after said perforations have been produced, a sealing fluid can be introduced through said first and second mandrels into said annulus such that a portion of said sealing fluid remains in said first and second mandrels.

16. The system of claim 15 wherein said system is further configured such that said opening sleeve can be moved to said closed position after said introduction of said sealing fluid so that said system further comprises sealing fluid in said annulus, in said first and second mandrels and above said second packer assembly.

* * * * *